US008459636B2

(12) United States Patent
Moulin et al.

(10) Patent No.: US 8,459,636 B2
(45) Date of Patent: Jun. 11, 2013

(54) DEVICE FOR STACKING FLAT ARTICLES ON EDGE AND A POSTAL SORTING MACHINE EQUIPPED WITH AT LEAST ONE SUCH DEVICE

(75) Inventors: Raphael Moulin, Gerzat (FR); Laurent Pellegrin, Livron (FR); Olivier De Sousa, Saint Uze (FR); Pierre Campagnolle, Allex (FR)

(73) Assignee: Solystic, Gentilly Cedex (FR)

( * ) Notice: Subject to any disclaimer, the term of this patent is extended or adjusted under 35 U.S.C. 154(b) by 103 days.

(21) Appl. No.: 13/203,782

(22) PCT Filed: May 30, 2011

(86) PCT No.: PCT/FR2011/051230

§ 371 (c)(1),
(2), (4) Date: Aug. 29, 2011

(87) PCT Pub. No.: WO2011/157919

PCT Pub. Date: Dec. 22, 2011

(65) Prior Publication Data

US 2012/0195732 A1 Aug. 2, 2012

(30) Foreign Application Priority Data

Jun. 17, 2010 (FR) ..... 10 54813

(51) Int. Cl.
*B65H 29/44* (2006.01)

(52) U.S. Cl.
USPC ..... 271/181; 271/180; 271/307; 271/308

(58) Field of Classification Search
USPC ..... 271/177, 178, 180, 181, 189, 306, 271/307, 308
See application file for complete search history.

(56) References Cited

U.S. PATENT DOCUMENTS

| | | | | |
|---|---|---|---|---|
| 2,844,373 | A | 7/1958 | Marle | |
| 3,166,313 | A * | 1/1965 | Rehm | 271/178 |
| 3,814,415 | A * | 6/1974 | Hunter et al. | 271/181 |
| 4,591,142 | A * | 5/1986 | Divoux et al. | 271/196 |
| 4,616,817 | A * | 10/1986 | Yamauchi et al. | 271/111 |
| 4,753,431 | A * | 6/1988 | Fujimoto et al. | 271/3.08 |

(Continued)

FOREIGN PATENT DOCUMENTS

| | | | |
|---|---|---|---|
| JP | 61 171762 | U | 10/1986 |
| JP | 6-183630 | A | 7/1994 |
| JP | 2003 03445 | A | 2/2003 |
| WO | 2009/127649 | A1 | 10/2009 |

OTHER PUBLICATIONS

International Search Report, PCT/FR2011/051230 dated Aug. 26, 2011 (2 pages).

*Primary Examiner* — Stefanos Karmis
*Assistant Examiner* — Ernesto Suarez
(74) *Attorney, Agent, or Firm* — Rothwell, Figg, Ernst & Manbeck, P.C.

(57) ABSTRACT

This device has an arrival corridor via which the articles arrive, an article-receiving zone on which a stack (P) of said articles is formed, and a rotary actuator (22) suitable for pushing said articles away against a retaining element (32) for retaining the stack. The actuator (22) has at least one protective member ($\mathbf{28}_1$, $\mathbf{28}_2$) for protecting the last article (N) in the stack (P) being formed, said protective member being suitable for being interposed between said last article and a current article (N+1) coming from the arrival corridor.

9 Claims, 3 Drawing Sheets

U.S. PATENT DOCUMENTS 6,634,639 B2 * 10/2003 Kuroda et al. ..... 271/178
7,850,165 B2 * 12/2010 Nagura et al. ..... 271/181
8,276,902 B2 * 10/2012 Holland-Letz et al. ..... 271/3.14
2002/0179503 A1 * 12/2002 Yap ..... 209/657
2003/0127509 A1 7/2003 Nomiyama et al.

* cited by examiner

DEVICE FOR STACKING FLAT ARTICLES ON EDGE AND A POSTAL SORTING MACHINE EQUIPPED WITH AT LEAST ONE SUCH DEVICE

CROSS REFERENCE TO RELATED APPLICATION(S)

This application is a 35 U.S.C. §371 National Phase Entry Application from PCT/FR2011/051230, filed May 30, 2011, designating the United States and also claims the benefit of French Application No. 1054813, filed Jun. 17, 2010, the disclosures of which are incorporated herein by reference in their entirety.

TECHNICAL FIELD

The invention relates to a device for stacking flat articles on edge, and to a postal sorting machine equipped with at least one such stacker device.

In the meaning of the invention, a "flat article" is, particularly but not exclusively, a mailpiece. Mailpieces that are suitable for being stacked by means of the stacker device of the invention may be of various dimensions, and may also have a variety of mechanical properties, in particular as regards stiffness. The mailpiece may, inter alia, be an ordinary letter, a magazine, an envelope with or without a window, a newspaper, or a catalogue wrapped in a plastics or paper envelope, with or without bellows.

PRIOR ART

A stacker device is usable, in particular, in postal sorting installations, e.g. for the purpose of forming a buffer receptacle for mailpieces at each sorting outlet of the installation. A sorting machine conventionally has a feed inlet with a magazine, and an unstacker for putting the mailpieces in series on edge. The mailpieces are then generally conveyed towards an acquisition system, and then directed towards sorting outlets that are in side-by-side alignment. Conventionally, a stacker device, such as the stacker device of the invention, equips each of said sorting outlets.

In known manner, the stacker device defines a zone of variable size, making it possible to receive the stack of articles that accumulate in a longitudinal direction. That zone is flanked transversely by a "jogging" edge against which the articles of the stack can come to bear. In addition, the front end of said stack comes to bear against a paddle that is movable longitudinally under the effect of the accumulation of the articles. Said paddle exerts a return force on said articles, enabling the articles to be held in their on-edge position.

In addition, the articles come to bear, via their edges on a support surface, along which they slide as they accumulate. Finally, a rotary actuator is caused to move on arrival of each article going towards the article-receiving zone.

The Applicant has marketed a stacker device under the reference "Virgule Equippée" (Article No. 285590). In that stacker, the actuator comprises a hub, from which a plurality of pairs of spurs extend. In addition, the spurs of the same pair are disposed symmetrically at 180° relative to each another. In service, the spurs periodically generate a longitudinal thrust fore, either directly on the paddle as the first articles arrive, or on the stack that is being formed.

That known stacker device is entirely suitable for handling letters, as confirmed by the commercial success that it is enjoying. However, it does not meet the need to stack other types of flat article in satisfactory manner. Such articles may, for example, be soft and floppy mailpieces, such as those wrapped in plastics envelopes, or those having fragile envelope flaps.

In addition, Publication US 2003/127 509 describes automated banknote management apparatus suitable for collecting and/or dispensing banknotes of various sizes. That automated apparatus includes, in particular, a banknote stacker device having a banknote arrival corridor, a banknote-receiving zone on which a stack of banknotes is formed, and a rotary actuator suitable for pushing the stack of banknotes away against a retaining element for retaining the stack. The rotary actuator is a wheel having curved spurs, the free end of each spur coming to be interposed between the banknote to be stacked and the top of the stack of banknotes so as to protect it. Banknotes are flat articles of thickness and of stiffness that are substantially constant, and that automated apparatus is not suitable for sorting mailpieces that are of various dimensions and/or that have a variety of mechanical characteristics.

Publication WO 2009/127 649 is also known that describes a banknote management device having a wheel with flaps or an actuator that is provided with spurs, that is substantially similar to the preceding actuator, that turns freely during stacking for collection purposes, and that does not turn during unstacking for dispensing purposes. As in the preceding publication, that device is suitable only for flat articles having dimensions and mechanical characteristics that are substantially constant.

Publication U.S. Pat. No. 2,844,373 is also known that describes a mailpiece stacker device having a motor-driven wheel provided with curved fingers, which wheel is suitable for pressing the stack being formed and for receiving and accompanying each mailpiece as it is being stacked. Finally, Publication JP 6 183 630 is known that describes a device for stacking printed sheets, which device has a wheel provided with slots that are suitable for receiving each sheet and accompanying it to its stacking zone. The stack is retained, in its bottom portion, by a latch. Unfortunately, such stacker devices suffer from major risks of collision between mailpieces.

SUMMARY OF THE INVENTION

An object of the invention is to remedy the various drawbacks of the prior art that are presented above. A particular object of the invention is to use the same stacker device to handle articles of various types while limiting the risks of collision. A further object of the invention is to propose such a device that is suitable for maintaining the structural integrity of the articles as they are being stacked.

To these ends, the invention provides a stacker device for stacking flat articles on edge, which stacker device comprises an article-receiving zone for receiving the flat articles and for stacking them on edge, which zone is disposed between an arrival corridor via which each flat article to be stacked arrives, and a jogging edge that flanks said article-receiving zone and against which edge said flat articles as stacked bear in order to form a stack of said flat articles, and a rotary actuator disposed opposite from said article-receiving zone and downstream from said arrival corridor so as to push said stack of flat articles away against a retaining element for retaining the stack, said actuator being provided with curved spurs for accompanying the movement of each flat article to be stacked onto the back of said stack of flat articles towards said jogging edge, said stacker device being characterized in that it further comprises a deflector flap disposed in said arrival corridor upstream from said actuator relative to the direction of advance of said flat articles, said deflector flap being mounted to pivot between a retracted position in which it does not project into said arrival corridor and does not interfere with the advance of a current flat article to be stacked and a deployed position in which it projects into said arrival corridor and comes to push away said stack of flat articles being formed, in that each spur of said actuator has a protective member suitable for being interposed between the current flat article and the last flat article of said stack being formed, and in that it further comprises control means for controlling said deflector flap and said actuator, which control means, in response to the presence of said current article being detected in said arrival corridor, cause said deflector flap to pivot towards its deployed position so as to push away said stack of flat articles and so as to define a space in the form of an inlet cone for said current article, and, in response to detection of the passing of the trailing portion of said current flat article, cause said deflector flap to pivot towards its deployed position in order to cause said current article to tilt while said actuator that is moving in rotation accompanies the movement of said flat article towards said jogging edge.

The basic idea of the invention is to interpose at least one protective member, carried by the actuator, between the leading portion of the article currently being stacked and the adjacent article that is part of the stack that is being formed. This thus makes it possible to isolate the facing surface of said adjacent article, so that it is protected from the arrival of the current article. This is particularly advantageous when the adjacent article is fragile, in view of the relatively high linear speed of the current article.

In addition, such a protective member is suitable for modifying the path of the current article. In particular, it can accompany the current article as it is arriving, so as to steer it towards the jogging edge. In other words, said protective member provides not only an interface function, but also an additional guide function. In particular, the deflector flap that is placed upstream from the actuator provided with curved spurs and that can take up a retracted position or a deployed position, and control means for controlling the deflector flap and the actuator, which control means are designed so that the deflector flap in the deployed position causes the trailing portion of a current article being stacked to tilt while the actuator accompanies the movement of the leading portion of said current article towards the jogging edge makes it possible to limit the risks of collision between the flat articles.

The stacker device of the invention may have the following advantageous characteristics:

- said protective member is a protective tongue that is substantially rectilinear and that extends a spur of said actuator, said protective tongue coming to form an interface between said current flat item and the last article of said stack being formed;
- said actuator is provided with two curved spurs disposed symmetrically about the axis of rotation of said actuator;
- said protective tongue is mounted removably on said spur;
- said protective tongue is made of a plastics material;
- during a stacking cycle for stacking the current flat article, said actuator turns through 180°;
- said control means for controlling said deflector flap are suitable for taking account of parameters chosen from the group comprising at least length, height, planeness, and component material of the flat article at the back of the current stack of flat articles being formed, and length, height, thickness, stiffness, kinetic energy, and component material of the current article to be stacked; and
- the device has a plurality of deflectors mounted to pivot about a common axis.

The invention also provides a postal sorting machine having sorting outlets for accumulating postal flat articles on edge, said machine being characterized in that each sorting outlet is provided with a stacker device as defined above.

BRIEF DESCRIPTION OF THE DRAWINGS

The invention can be better understood on reading the following description given by way of example that is in no way limiting on the invention, and with reference to the accompanying drawings, in which.

DESCRIPTION OF EMBODIMENTS

Figure 1:
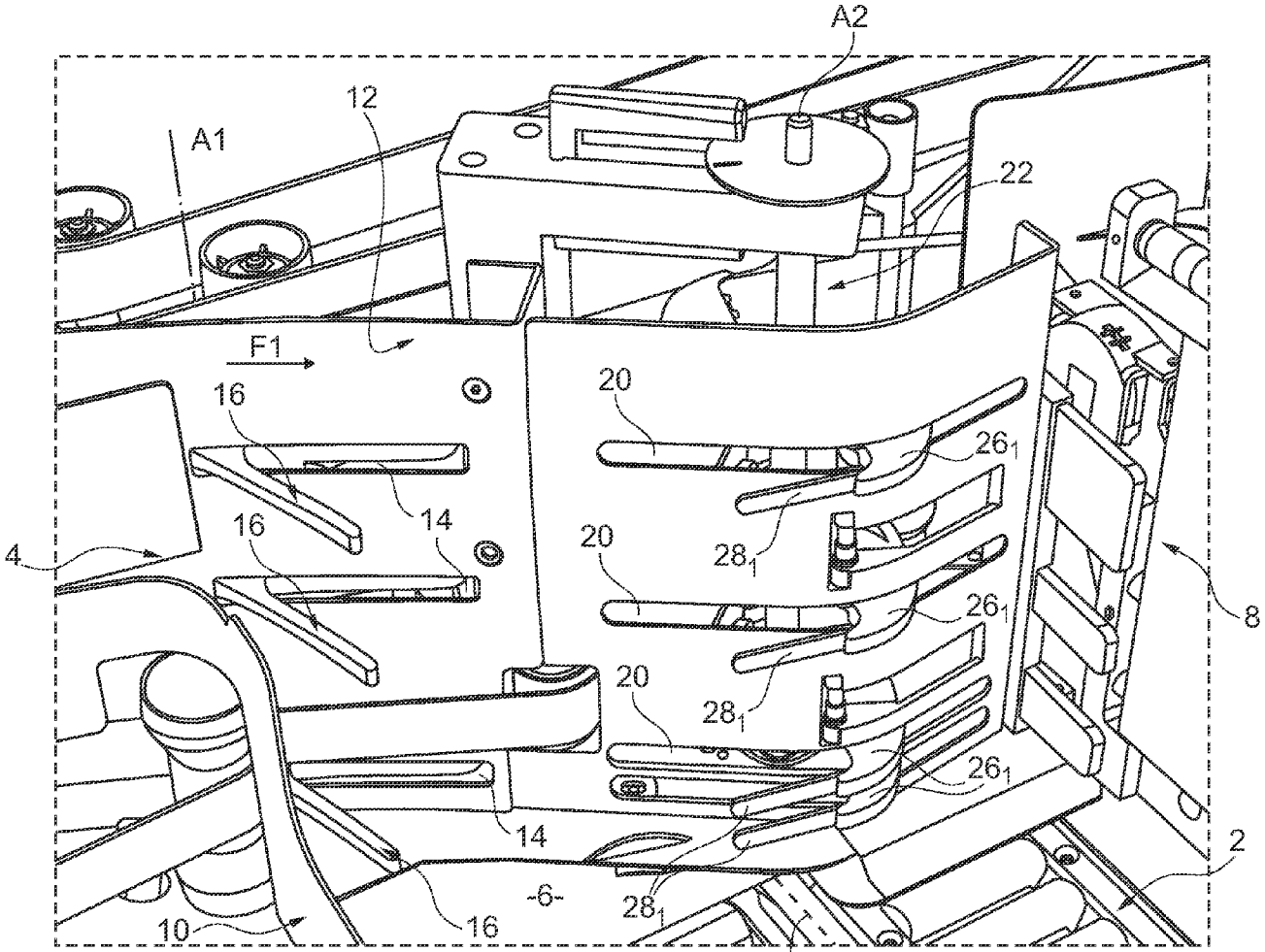
FIG. 1 is a perspective view of a stacker device of the invention.

The stacker device of the invention includes firstly a stationary frame that is designated by reference 2. It also has an inlet corridor 4, through which the flat articles arrive. Typically, this inlet is put into communication with a conveyor device (not shown) that is part of a conventional-type sorting machine.

This stacker device further defines an article-receiving zone 6 for receiving the articles, which zone is flanked on one side by a jogging edge 8, against which the flat articles bear, and on the other side by a retaining edge 10. The longitudinal direction of the device is referenced D, and the stack of articles moves in said longitudinal direction as the stack is being formed. A plate 12 forming a slide edge makes it possible to guide, as indicated by the arrow F1, the flow of articles admitted from the inlet 4 towards the zone 6.

In its upstream portion, relative to the direction of advance of the articles, the plate 12 is provided with a first series of slots 14. Said slots make it possible for a plurality of flaps 16 to pass through them, there being three such flaps in the example shown. These flaps are suitable for pivoting about a vertical axis A1 that extends in the vicinity of the back face of the plate 12.

As explained in more detail below, each flap can pivot about the axis A1 between two positions. The first of these positions is a retracted position, in which the flaps are retracted behind the plate 12, i.e. they do not project into the inlet corridor 4, and they thus do not interfere with the advance of the articles. In the "deployed" second position, the flaps project into the corridor in such a manner as to influence the path of the articles, as explained below.

In its downstream portion, the plate 12 is provided with a second series of slots 20. These slots co-operate with an actuator 22 suitable for being driven in rotation about a vertical axis A2, which is placed some distance away from the plate, opposite from the article-receiving zone 6.

Figure 2:
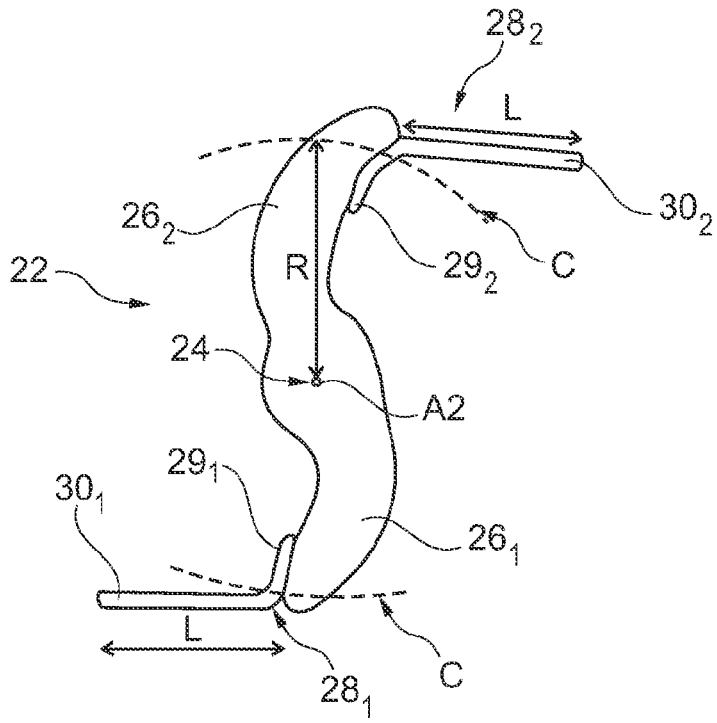
FIG. 2 is a plan view showing, more particularly, an actuator that is part of said stacker device.

As shown more particularly in FIG. 2, this actuator 22 has a central hub 24, from which a plurality of pairs of spurs extend, only one of which pairs $\mathbf{26}_1$, $\mathbf{26}_2$ is visible in FIG. 2. Said spurs are suitable for projecting towards the article-receiving zone, via the above-mentioned slots 20. In addition, these spurs are slightly curved in such a manner as to point towards the arrival corridor, when they extend through said slots.

More precisely, in the example shown, there are four pairs of such spurs, distributed along the hub. In addition, for any given pair, the two spurs extend symmetrically, while thus being offset mutually by 180°.

Each spur $\mathbf{26}_1$, $\mathbf{26}_2$ is associated with a tongue $\mathbf{28}_1$, $\mathbf{28}_2$ that is mounted thereon, advantageously removably, e.g. by screw-fastening. The tongues can be made of a material different from the material of which the spurs are made, in particular, of a plastics material, while the spurs are made of metal. In this way, the tongues can have characteristics fit for their purpose, while also being easy to replace.

Each tongue has a portion $\mathbf{29}_1$, $\mathbf{29}_2$ of curved shape, with a view to fastening it to the spur, and a rectilinear main portion $\mathbf{30}_1$, $\mathbf{30}_2$, the function of which is described in detail below. By way of non-limiting example, the length L of the main portion $\mathbf{30}_1$, $\mathbf{30}_2$, namely the distance between its free end and its junction where it meets the spur, is advantageously greater than 40 millimeters (mm), in particular lying in the range 40 mm to 60 mm. In FIG. 2, it can be noted that each tongue $\mathbf{28}_1$, $\mathbf{28}_2$ extends tangentially to a circle C that is centered on the axis A2, and that has a radius R lying in the range 60 mm to 80 mm.

Figure 3:
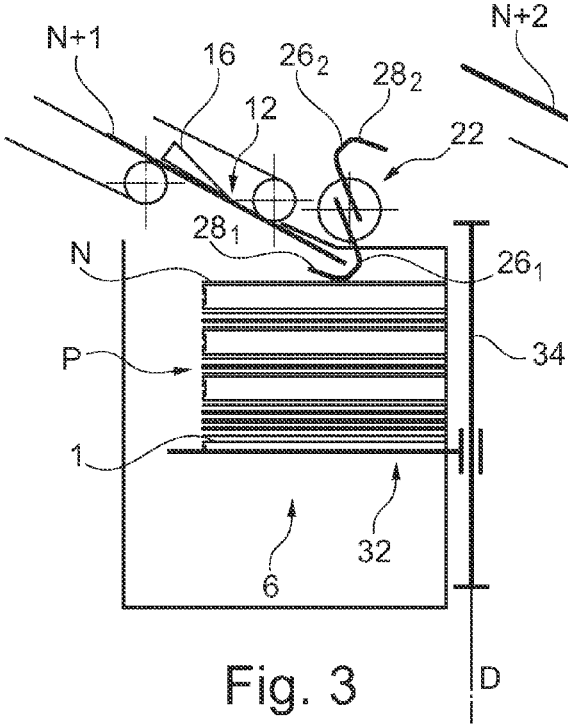
FIGS. 3 to 6 are diagrammatic plan views showing successive steps in using said stacker device.

The longitudinal end of the article-receiving zone that is opposite from the actuator is defined by a paddle 32, forming a retaining element in the usual manner (see FIG. 3 et seq.). This paddle is mounted to move relative to the frame, in the direction D, while being mounted on a guide 34. In addition, means (not shown) of the winder or counterweight type are associated with the paddle so that it exerts a return force on the stack of articles, in such a manner as to retain said stack.

Use of the above-described stacker device of the invention is explained below.

There follows a description of the arrival of a "current" article N+1 that is to be stacked on a stack P that is "being formed", which stack is made up of N flat articles, referenced 1 to N, that have been admitted previously into the article-receiving zone 6. By convention, the respective articles 1 and N are referred to as the "first" and "last" articles in the stack being formed.

The same procedure applies for the first flat article that arrives, i.e. when the stacker device is empty. However, in that situation, during the initial operating stage, the actuator bears directly against the paddle, rather than against the immediately previously stacked article N.

Figure 4:
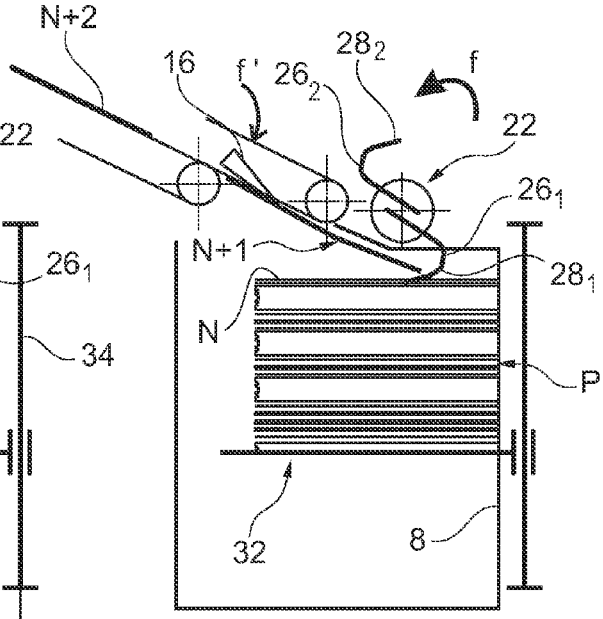

In the initial position, shown in FIG. 3, the actuator 22 is stationary. The article N+1 travels firstly along the slide edge 12 towards the first series of spurs $\mathbf{26}_1$ that bear against the stack being formed P. Immediately before the article N+1 comes into contact with said spurs, the actuator 22 is caused to start moving in rotation (see arrow f in FIG. 4). In this way, instead of coming into contact with said spurs $\mathbf{26}_1$, the leading edge of said article comes into contact with the inside faces of the tongues $\mathbf{28}_1$ associated with said spurs (the inside faces of the tongues being the faces that face the hub 24).

Due to the actuator being caused to move in rotation, the tongues thus perform a function of deflector for the article N+1, because they tend to impart to it a path that is almost parallel to the article N, towards the jogging edge 8. In addition, said tongues act as interfaces between the articles N and N+1, i.e. in particular, they isolate the leading edge of the mailpiece N+1 being stacked from the previously stacked article N. It can thus be understood that this makes it possible to guarantee the structural integrity of the article N, in particular when said article is fragile.

Figure 5:
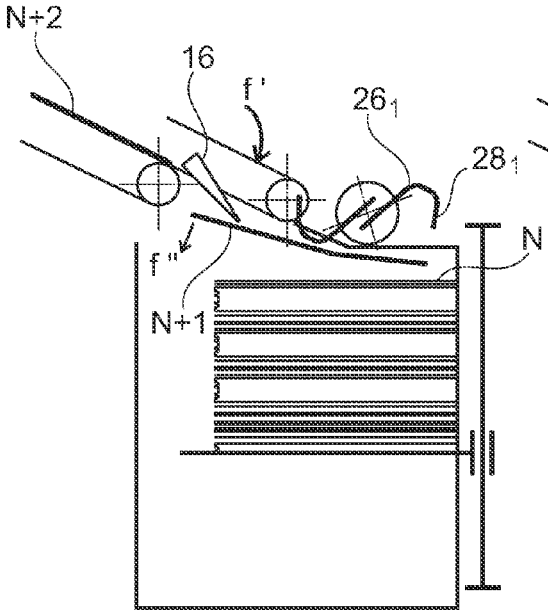

In addition, when the trailing portion of the mailpiece N+1 comes into register with the flaps 16, said flaps are caused to pivot as indicated by arrow f' (see FIGS. 4 and 5), in such a manner as to cause said mailpiece to tilt as indicated by arrow f". This also contributes to making the path of said mailpiece parallel to the facing surface of the preceding mailpiece N, in combination with the deflecting action of the tongues $\mathbf{28}_1$, as described above.

Figure 6:
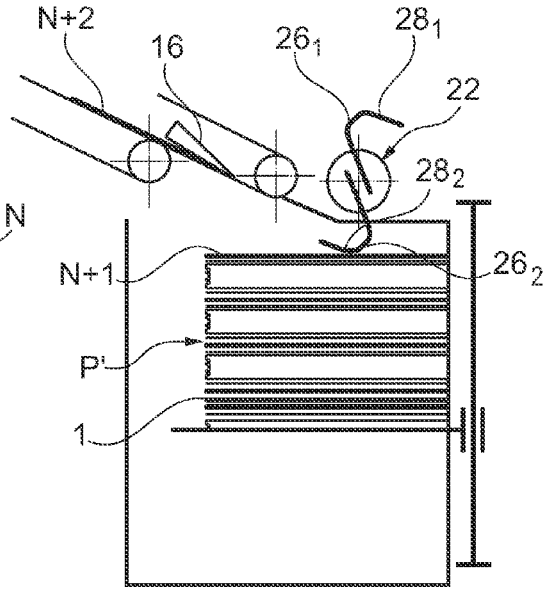

The article N+1 then comes into abutment against the jogging edge 8, while any bouncing-back is limited by the retaining edge 10. The actuator is kept moving in rotation, so that the outside faces of the second series of tongues $\mathbf{28}_2$ hit said article N+1 that is now stacked (see FIG. 6). This contributes to the overall stability of the new stack being formed P', which is now made up of N+1 articles.

Then, the movement in rotation of the actuator is stopped, so that the second spurs $\mathbf{26}_2$ and the second tongues $\mathbf{28}_2$ then occupy the positions of the first spurs $\mathbf{26}_1$ and of the first tongues $\mathbf{28}_1$, as shown in FIG. 3. Thus, a handling cycle corresponds to the actuator moving in rotation through 180°. It is then possible to stack the next article N+2, visible in FIGS. 4 to 6, in a manner analogous to the manner described above.

Figure 7:
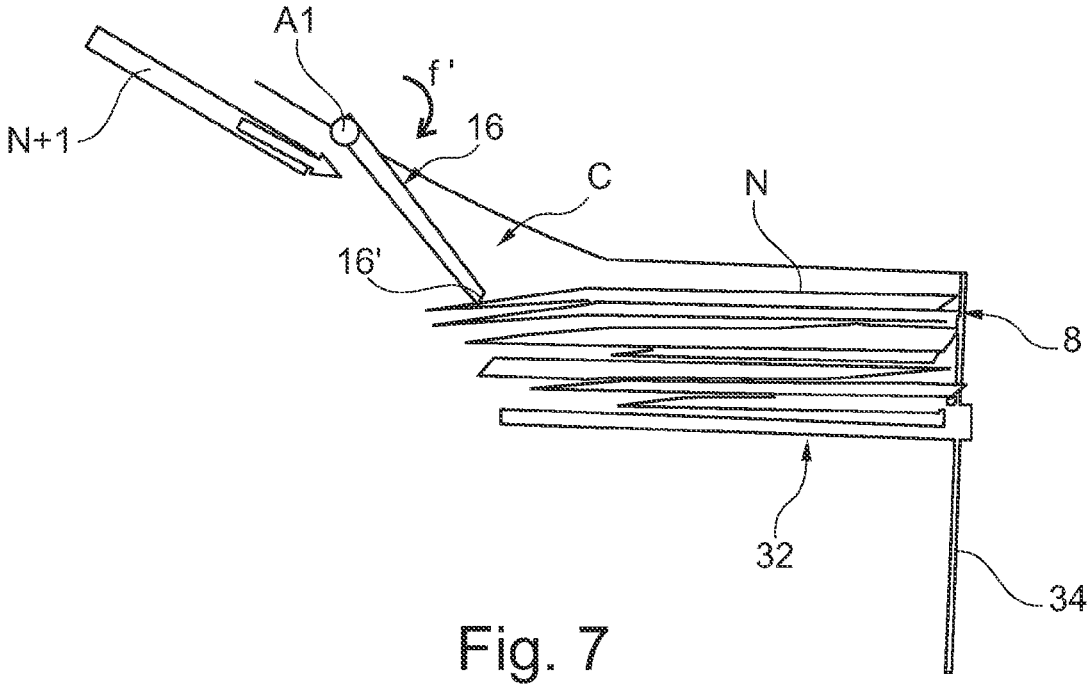
FIG. 7 is a diagrammatic plan view showing the use of a flap that is part of said stacker device.

FIG. 7 shows an advantageous way of using the above-described flaps 16. The arrival of the current flat article N+1 is detected, and, before it comes into register with the flaps, said flaps are caused to pivot as indicated by arrow f'. Under these conditions, said flaps hit the article N of the stack being formed with their free ends 16', thereby making it possible to push the stack away towards the paddle 32.

This action of the flaps thus defines a free path for the article N+1, which path may also be referred to as an "inlet cone" C, thereby avoiding any collision between the article N+1 and the stack being formed, upstream from the article-receiving zone. Therefore, the risks of jamming are significantly reduced. After the stack being formed has been pushed away, the flaps are retracted once again, so as not to hinder free advance of the article N+1.

The pivoting of the flaps as described above, with reference to FIGS. 4 and 5 for a first variant implementation, and with reference to FIG. 7 for a second variant implementation, may be initiated as a function of various parameters, relative, in particular, to the last mailpiece N of the stack being formed and to the current mailpiece N+1. Mention can be made, in particular, by way of non-limiting example, of the length, the height, the evenness, and the component material of the flat article N, and of the length, the height, the thickness, the stiffness, the kinetic energy, and the component material of the mailpiece N+1.

As of the beginning of sorting, after the articles have been separated one-by-one or "singulated", upstream from the stacking process, these various parameters are acquired by means of suitable sensors. Then, as a function of at least some of said parameters, pivoting of the flaps is initiated, using either one of the above implementations.

It should be noted that the above flaps are advantageous per se, even if they are used with an actuator not having protective members. Thus, they can be used in combination with prior art actuators, such as those mentioned in the introduction of the present application.

The invention claimed is:

1. A stacker device for stacking postal flat articles, which stacker device comprises:

an article-receiving zone for receiving the flat articles and for stacking them on edge, which zone is disposed between an arrival corridor via which each flat article to be stacked arrives, and a jogging edge that flanks said article-receiving zone and against which edge said flat articles as stacked bear in order to form a stack of said flat articles;

a rotary actuator disposed opposite from said article-receiving zone and downstream from said arrival corridor so as to push said stack of flat articles away against a retaining element for retaining the stack, said actuator being provided with curved spurs for accompanying the movement of each flat article to be stacked onto the back of said stack of flat articles towards said jogging edge;

a deflector flap disposed in said arrival corridor upstream from said actuator relative to the direction of advance of said flat articles, said deflector flap being mounted to pivot between a retracted position in which it does not project into said arrival corridor and does not interfere with the advance of a current flat article to be stacked and a deployed position in which it projects into said arrival corridor and comes to push away said stack of flat articles being formed, wherein each spur of said actuator has a protective member suitable for being interposed between the current flat article and the last flat article of said stack being formed; and control means for controlling said deflector flap and said actuator, wherein said control means, in response to the presence of said current flat article being detected in said arrival corridor by a sensor, pivots said deflector flap to the deployed position so as to push away said stack of flat articles and so as to define a space in the form of an inlet cone for said current flat article, then pivots the deflector flap back to the retracted position and in response to the detection of the passing of a trailing end portion of said current flat article in said arrival corridor, pivots said deflector flap to the deployed position to tilt said current flat article while said rotary actuator is rotating, to move the current flat article towards said jogging edge.

2. A stacker device according to claim 1, wherein said protective member is a protective tongue that is substantially rectilinear and that extends a spur of said actuator, said protective tongue coming to form an interface between said current flat item and the last article of said stack being formed.

3. A stacker device according to claim 2, wherein said actuator is provided with two curved spurs disposed symmetrically about the axis of rotation of said actuator.

4. A stacker device according to claim 2, wherein said protective tongue is mounted removably on said spur.

5. A device according to claim 2, wherein said protective tongue is made of a plastics material.

6. A device according to claim 1, wherein during a stacking cycle for stacking the current flat article, said actuator turns through 180°.

7. A device according to claim 1, wherein said control means for controlling said deflector flap are suitable for taking account of parameters chosen from the group comprising at least length, height, evenness, and component material of the flat article at the back of the current stack of flat articles being formed, and length, height, thickness, stiffness, kinetic energy, and component material of the current article to be stacked.

8. A device according to claim 1, further comprising a plurality of deflector flaps mounted to pivot about a common axis between said retracted and deployed positions.

9. A postal sorting machine having sorting outlets for accumulating postal flat articles on edge, said machine being characterized in that each sorting outlet is provided with a stacker device according to claim 1.

* * * * *